US007048655B2

(12) United States Patent
Nye et al.

(10) Patent No.: US 7,048,655 B2
(45) **Date of Patent: *May 23, 2006**

(54) BASKETBALL RIM ASSEMBLY

(75) Inventors: S. Curtis Nye, Clinton, UT (US); Carl R. Stanford, Clinton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 39 days.

This patent is subject to a terminal disclaimer.

(21) Appl. No.: 10/802,433

(22) Filed: Mar. 17, 2004

(65) Prior Publication Data

US 2005/0003910 A1 Jan. 6, 2005

Related U.S. Application Data

(60) Provisional application No. 60/455,647, filed on Mar. 18, 2003.

(51) Int. Cl.
*A63B 63/08* (2006.01)

(52) U.S. Cl. ..... 473/486; 473/481; 473/483; 473/484; 248/283.1; 248/280.11; D21/701

(58) Field of Classification Search ..... 473/479, 473/480, 481, 486, 483; D21/701; 248/283.1, 248/280.11

See application file for complete search history.

(56) References Cited

U.S. PATENT DOCUMENTS 2,932,511 A * 4/1960 Bemis ..... 473/481
3,365,196 A * 1/1968 Miller ..... 473/485
3,970,304 A * 7/1976 Ebstein et al. ..... 473/481
4,465,277 A * 8/1984 Dittrich ..... 473/447
D498,800 S * 11/2004 Nye et al. ..... D21/701

* cited by examiner

*Primary Examiner*—Eugene Kim
*Assistant Examiner*—M. Chambers
(74) *Attorney, Agent, or Firm*—Workman Nydegger

(57) ABSTRACT

A basketball goal system may include a rim assembly that forms part of a breakaway rim that can deflect downwardly when a force larger than a predetermined amount is applied to the rim. The basketball goal system may include a support pole, a support structure including a pair of upper arms and a pair of lower arms, a backboard support frame including a pair of elongated members, and a backboard. The elongated members of the backboard support frame are preferably connected to one of the upper support arms and one of the lower support arms of the support structure, and these upper and lower support arms are preferably connected to the support pole. The basketball goal system may also include a backboard connected to the backboard support frame and a rim assembly including a pair of support arms. The support arms of the rim assembly are preferably connected to the elongated members of the backboard support frame. The basketball goal system may also include a rim attached to the rim assembly and a resistance mechanism that is preferably connected to the pair of elongated members of the backboard support frame and the pair of support arms of the rim assembly.

26 Claims, 4 Drawing Sheets

BASKETBALL RIM ASSEMBLY

CROSS-REFERENCE TO RELATED APPLICATIONS

This application claims priority to and the benefit of U.S. provisional patent application Ser. No. 60/455,647, which was filed on Mar. 18, 2003, entitled Modern Basketball Rim Assembly, which is incorporated by reference in its entirety.

BACKGROUND OF THE INVENTION

1. Field of the Invention

This invention is generally related to a basketball goal system and, in particular, to a rim assembly for a basketball goal.

2. Description of Related Art

The game of basketball is played by many people throughout the United States and the world. Briefly, the game of basketball includes a flat and level playing surface with a basketball goal at each end of a court. The basketball goal typically includes a support pole with a backboard and rim or hoop attached to the top of the support pole. The rim or hoop is normally located ten feet above the playing surface and the backboard is constructed from materials such as wood, plastic or tempered glass.

Conventional basketball goals often include rigidly mounting the hoop to the basketball backboard so that the face of the backboard is positioned perpendicular to the playing surface and the hoop is positioned parallel to the playing surface. The mounting of the hoop to the backboard must be sufficiently rigid so that the hoop remains in a generally stationary position and parallel to the playing surface. In addition, the hoop must be securely attached to the backboard so that the hoop is capable of withstanding various forces and impacts during the game of basketball. For example, the hoop must remain in a generally stationary position and parallel to the playing surface so that the basketball rebounds and bounces off the rim in a consistent, dependable manner.

In addition, the hoop must be able to withstand various impacts during the game. For example, in recent years it has become increasingly popular for players to "dunk" the basketball by throwing the basketball through the hoop with great force. In particular, the player throws the basketball through the hoop from a position above the rim. While it is possible to dunk the basketball without the basketball or the player touching the hoop, it is not uncommon for the player to strike the rim with the basketball and/or his or her hands and arms while dunking the basketball. In addition, the player may even momentarily grab or hang onto the rim while dunking the basketball. Players may also occasionally hold or suspend themselves from the hoop to prevent themselves from falling, to regain their balance and/or to prevent themselves from landing on another player. These forces caused by dunking the basketball and players grabbing or suspending themselves from the hoop impart substantial forces on the rim and basketball backboard.

If the force applied to the basketball hoop is excessive, then many problems could result. For example, the hoop may be bent such that it is no longer parallel to the playing surface. This is very undesirable because if the hoop is not horizontal and parallel to the playing surface, then the basketball will not bounce or rebound consistently or correctly. After a hoop has been bent into a deformed position, it is very difficult, if not impossible, to restore the hoop to its original, horizontal position. Thus, the hoop must usually be replaced, which is often time consuming and difficult to accomplish. Further, because hoops used in connection with home, playground and portable basketball systems are often not as strong and durable as hoops used for professional basketball systems, these hoops are more likely to be bent and deformed. Therefore, hoops used in connection with home, playground and portable basketball systems are more likely to be damaged and in need of replacement.

Additionally, if excessive force is applied to the rim and the basketball backboard is constructed from tempered glass, then the glass may shatter. This may result in injury to players surrounding the goal and spectators in the immediate area. In addition, the tempered glass backboard has to be replaced before the game can be continued. Unfortunately, replacing the glass backboard requires a substantial amount of time and that results in an unacceptable delay of the basketball game. Additionally, it can be very expensive to replace glass backboards each time they are damaged.

The force applied to the rim may also damage basketball backboards constructed from materials other than tempered glass. For example, basketball backboards may also be manufactured using thermoformed plastic. Thermoformed plastic is a relatively strong material, but it is also brittle. The brittle nature of the thermoformed plastic makes it susceptible to cracking or shattering upon impact. Additionally, thermoformed plastic backboards often require the use of strengthening ribs and reinforcement structures in order to increase the stiffness and rigidity of the backboard. These ribs and reinforcement structures often detract from the aesthetics of the backboard and add to the complexity of the design and manufacturing process. Further, thermoformed plastic basketballs are often constructed from two or more pieces that must be assembled together. Accordingly, thermoformed plastic backboards often require additional parts and time to manufacture. Therefore, thermoformed plastic backboards are relatively costly to manufacture.

While basketball backboards constructed from thermoformed plastic are generally more resistant to shattering or breaking than tempered glass backboards, thermoformed plastic backboards may still break or shatter when a player dunks the basketball or otherwise contacts the rim. Thermoformed plastic backboards may also be very difficult or impossible to repair. Thus, the entire backboard may have to be replaced, which may be time consuming and expensive.

It is also known to construct basketball backboard from other materials such as injection molded plastic. Injection molded plastic backboards may also be damaged or broken if excessive force is applied to the hoop. For example, if the hoop is bolted to the backboard, then the force on the rim may cause the connection of the rim to the backboard to be broken by pulling the bolts out of the backboard or breaking that portion of the backboard. Thus, additional parts and other structures may be required to increase the strength of that portion of the backboard and prevent the backboard from being damaged.

It is known to use a basketball hoop that will "breakaway" or deflect from its original horizontal position when a force greater than a predetermined amount is applied to the hoop in order to prevent damage to the rim or backboard. In particular, when a force greater than the predetermined amount is applied to the hoop, the rim is allowed to pivot downwardly before the rim or backboard is damaged. These known breakaway rims allow the hoop to maintain its horizontal position during regular play when forces such as the basketball bouncing off of the hoop are applied. The breakaway rims, however, deflect downwardly when a substantial amount of force is applied to the hoop, such as someone dunking a basketball or grabbing the rim, in order to absorb much of the energy applied to the hoop.

Known breakaway rims, however, are very complex and include multiple parts. Most known breakaway rims position the various mechanisms and parts in a very limited space. This small area forces the parts to be very small and spaced very close together, which increases manufacturing time and costs. This also makes these known breakaway rims very difficult to adjust and repair. Additionally, known breakaway rims often include multiple moving parts that are subject to wear over time. Disadvantageously, if the parts being to wear, then the hoop to be held in a less than stable and rigid position, which is very undesirable when playing basketball because the rim may "give" or move during the game. The worn parts may also not maintain the hoop parallel to the playing surface and the rim may undesirably be disposed at an angle. In addition, these known breakaway rims may create a safety hazard because the mechanisms and parts that are located in front of the backboard may allow the hands or fingers of the players to be caught or injured. Further, the forwardly extending components of the breakaway rim may also create an aesthetically unpleasing design and the components may be difficult to install or replace.

As with most mechanical systems, the complexity of known breakaway basketball rims results in several disadvantages. For example, conventional breakaway rims are often expensive to manufacture because of the large number of parts and time required to assemble the parts, which generally results in an increased price to the consumer. The complex nature of these known breakaway rims may also lead to a greater frequency of failure. In addition, many previous breakaway rims are constructed of materials which are not designed for outdoor use. Thus, the parts may prematurely rust or corrode if used outside. Further, the relatively small components located in a very compact area make these known breakaway basketball rims difficult to repair and replace.

Additionally, conventional breakaway rims are typically directly mounted to the backboard by bolts or screws. Thus, holes or opening must be created in the backboard, which is time consuming during the manufacturing process and the holes may weaken or decrease the structural integrity of the backboard. In addition, because the rim is attached to the backboard, forces applied to the rim are directly transferred from the rim to the backboard. This transfer of the force from the hoop to the backboard can cause unnecessary wear and/or damage to the backboard. For instance, if a player dunks a basketball or grabs the rim, that may create a downward force on the rim. This force on the rim may be directly transmitted to the backboard, which may damage the connection of the rim to the backboard and/or the backboard itself.

BRIEF SUMMARY OF THE INVENTION

A need therefore exists for a basketball goal system that eliminates the above-described disadvantages and problems.

One aspect of the invention is a basketball rim assembly that helps support a basketball rim above a playing surface. The basketball rim assembly desirably supports the rim such that it is generally parallel to the playing surface. The basketball rim assembly may also allow the rim to pivot or move when a large force is applied to the rim.

Another aspect is the basketball rim assembly may be part of a basketball goal system that includes features such as a basketball backboard, a backboard frame, a backboard support structure, arms for connecting the basketball backboard or frame to a support pole, and/or a height adjustment mechanism that allows the height of the rim to be adjusted. Advantageously, the basketball goal system can include all or only a few of these features depending, for example, upon the intended use of the basketball goal system.

Still another aspect is the basketball rim assembly may include a breakaway rim that allows pivotal movement or deflection of the rim in response to an impact, load or force applied to the rim. In particular, the breakaway rim is normally in a horizontal position and parallel to the playing surface when playing basketball, but the rim can downwardly deflect to absorb significant impacts or forces on the rim to help prevent injury to players and damage to the rim or backboard. Advantageously, the breakaway rim may have the feel and characteristics of a fixed, stationary rim, but it can pivot or deflect downwardly when a force larger than a predetermined amount is placed on the rim. The breakaway rim preferably has few moving parts, is long lasting, has a pleasing aesthetic appearance, and a relatively straight-formed design.

Yet another aspect is the basketball rim assembly may include a resistance mechanism that maintains the hoop in its normal position during play, allows the hoop to deflect when a force exceeding a predetermined amount is exerted on the rim and returns the hoop to its original position after it has been deflected. The resistance mechanism desirably includes one or more springs or other types of flexible and/or resilient members. The resistance mechanism may also be adjustable to allow the amount of force required to deflect the rim to be adjusted.

A further aspect is the basketball rim assembly may be attached to the basketball backboard frame or support structure independently of the backboard. Thus, forces applied to the rim while playing basketball are not transmitted directly to the backboard, which helps prevent damage or breakage of the backboard. In contrast, forces are transmitted directly from the rim to the backboard frame or support structure. Additionally, no openings or holes must be formed in the backboard to allow the rim to be attached to the backboard. Thus, no stress concentrations or other features that may decrease the strength of the backboard are created because the rim is preferably not attached to the backboard.

Another aspect is the basketball rim assembly may include a resistance mechanism that does not interfere with the location or design of other components such as the backboard frame, support pole, support structure or mechanisms that allow the height of the basketball goal to be adjusted. Desirably the resistance mechanism is located between the rim and the basketball backboard frame. In particular, the resistance mechanism is preferably pivotally attached to the rim support arms and the basketball backboard frame. Advantageously, the resistance mechanism may be at least partially disposed between the rim support arms. Significantly, the resistance mechanism can be disconnected from the rim support arms and/or the backboard frame to assist in packaging and/or shipping of the basketball goal system.

Still another aspect is the basketball rim assembly may include one or more support arms that are connected to the rim. Preferably the rim assembly includes two support arms and the support arms are attached to a rear portion of the rim and the basketball backboard frame and/or support structure. Advantageously, the rim support arms may be disconnected from the rim and/or the backboard frame or support structure to assist in packaging and/or shipping, but the rim and rim support arms may also be constructed from a single or multiple parts.

Yet another aspect is the basketball rim assembly may be used in connection with a basketball system that is adjustable in height. This may allow a wide variety of people to play basketball. Desirably, the basketball rim assembly is sized and configured such that it does not interfere with the design and/or location of the height adjustment mechanism. Additionally, the rim assembly is preferably sized and configured such that it does not interfere with a counterbalance or other structures that facilitate adjustment of the basketball goal system.

Advantageously, the basketball rim assembly is relatively uncomplicated, cost effective and easy to manufacture. Further, the basketball rim assembly has a rather straightforward design and is simple to maintain because it has few parts. In addition, the basketball rim assembly can be used with portable basketball systems or systems that are designed to be fixed in a desired location.

Significantly, the basketball rim assembly may have a relatively small and compact design. In addition, the basketball rim assembly may be easily assembled and disassembled by the manufacturer or customer. These features may decrease shipping and transportation costs. Further, the small and compact size of the rim assembly may allow a basketball system with a pleasing appearance and design to be created.

Another aspect is a basketball goal system that may include a support pole; a backboard; a support frame connected to the backboard, the support frame including two elongated members that extend below a lower portion of the backboard; a support structure including a pair of upper arms and a pair of lower arms, the pair of upper arms being connected to the support pole and an upper portion of the elongated members of the support frame, the pair of lower arms being connected to the support pole and a lower portion of the elongated members of the support frame; a rim assembly including a pair of support arms that are connected to the lower portion of the elongated members of the support frame and the lower pair of arms of the support structure; and a rim attached to the rim assembly. The basketball goal system may also include a resistance mechanism connected to the elongated members of the support frame and the support arms of the rim assembly. Desirably, a first end of the resistance mechanism is disposed between the elongated members of the support frame and a second end of the resistance mechanism is disposed between the support arms of the rim assembly A further aspect is a basketball goal system that may include a support pole; a backboard; a backboard support frame connected to the backboard; a support structure connecting the backboard support frame to the support pole; a rim; a rim assembly including a first end and a second end, the first end of the rim assembly being connected to the backboard support frame, the second end of the rim assembly being connect to the rim; and an elongated connector including a first end that is connected to the backboard support frame and a second end that is connected to the rim assembly proximate the rim. The elongated connector may include a resistance mechanism and the lower portion of the backboard support frame may extend below a lower portion of the backboard. Desirably, the rim assembly and the elongated connector are connected to the lower portion of the backboard support frame that extends below the lower portion of the backboard.

Yet another aspect is a basketball goal system may include a support structure including a pair of upper support arms and a pair of lower support arms; a backboard support frame including a pair of elongated members, each of the elongated members being connected to one of the upper support arms and one of the lower support arms of the support structure; a backboard connected to the backboard support frame; a rim assembly including a pair of support arms, each of the support arms being connected to one of the elongated members of the backboard support frame; a rim attached to the rim assembly; and a resistance mechanism connected to the pair of elongated members of the backboard support frame and the pair of support arms of the rim assembly. Desirably, the resistance mechanism is connected to the rim assembly proximate the rim.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF PREFERRED EMBODIMENTS

The present invention is directed towards a basketball rim assembly. The principles of the present invention, however, are not limited to basketball rim assemblies. It will be understood that, in light of the present disclosure, the basketball rim assembly disclosed herein can be successfully used in connection with other types of basketball and sporting equipment.

Additionally, to assist in the description of the basketball rim assembly, words such as top, bottom, front, rear, right and left are used to describe the accompanying figures. It will be appreciated, however, that the rim assembly can be located in a variety of desired positions—including various angles, sideways and even upside down. A detailed description of the basketball rim assembly now follows.

Figure 1:
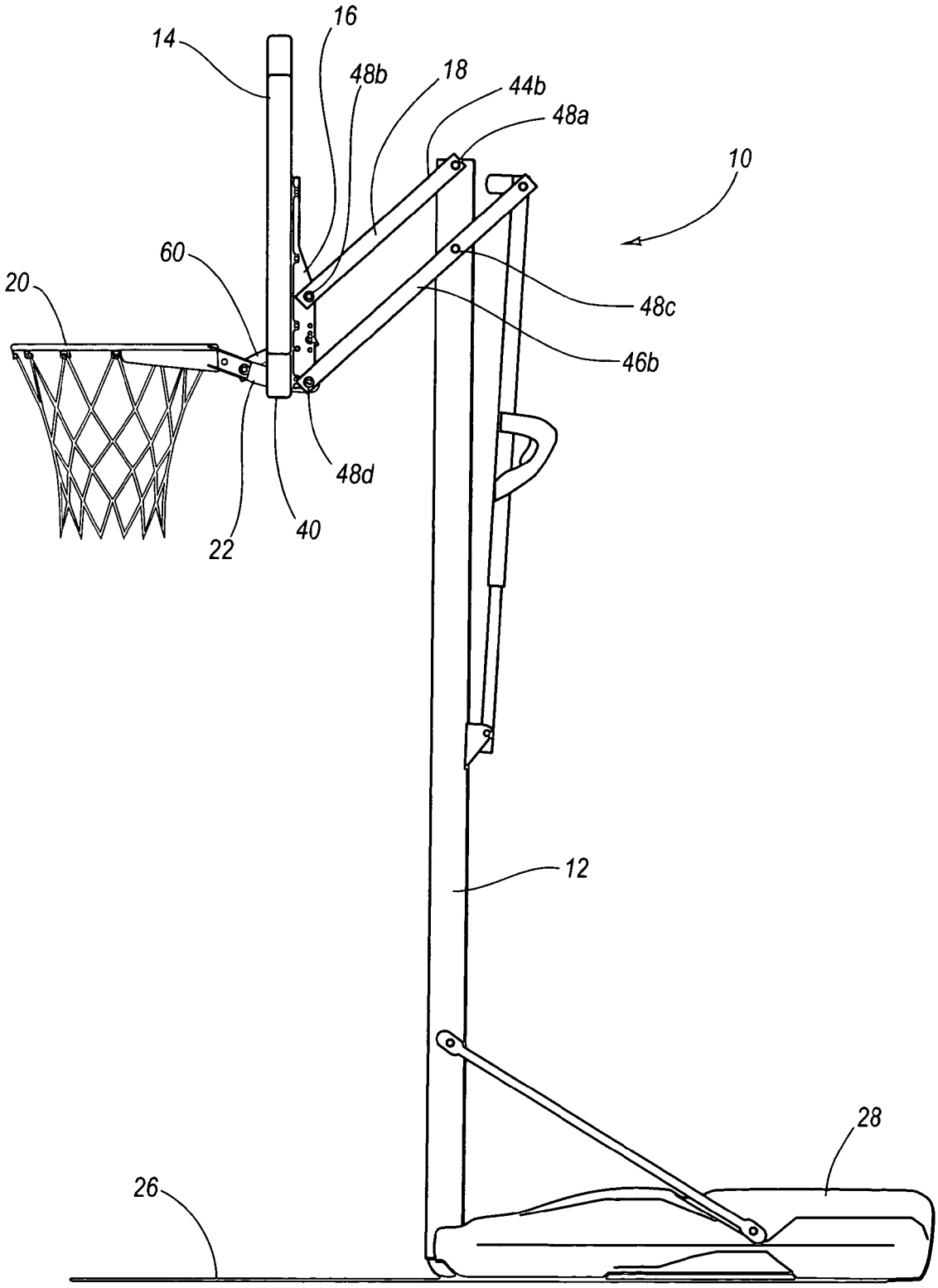
FIG. 1 is a side view of an exemplary embodiment of a basketball goal system, illustrating a backboard, backboard frame, rim assembly, adjustable support arms, support pole, height adjustment mechanism and a portable base.

As seen in FIG. 1, an exemplary embodiment of a basketball goal system 10 may include a support pole 12, backboard 14, a support frame for the backboard 16 and a support structure 18 that connects the backboard support frame to the support pole. The basketball goal system 10 may also include a rim 20 and a rim assembly 22 that connects the rim to backboard support frame 16 and/or the support structure 18. As discussed in greater detail below, the basketball goal system 10 may include a height adjustment mechanism 24 that allows the height of the rim 20 to be adjusted relative to a playing surface 26. The support pole 12 of the basketball goal system 10 may also be attached to a base 28 and, as discussed in greater detail below, the base may be part of a portable basketball system. One of ordinary skill in the art will appreciate that the basketball goal system 10 may be part of any suitable type of basketball system, including systems that are intended to be permanently fixed in a particular location. One of ordinary skill in the art will also appreciate that the basketball goal system 10 can include all or only some of these features discussed in conjunction with the accompanying figures, and the basketball goal system can have other suitable arrangements and configurations depending, for example, upon the intended use of the basketball system.

Figure 2:
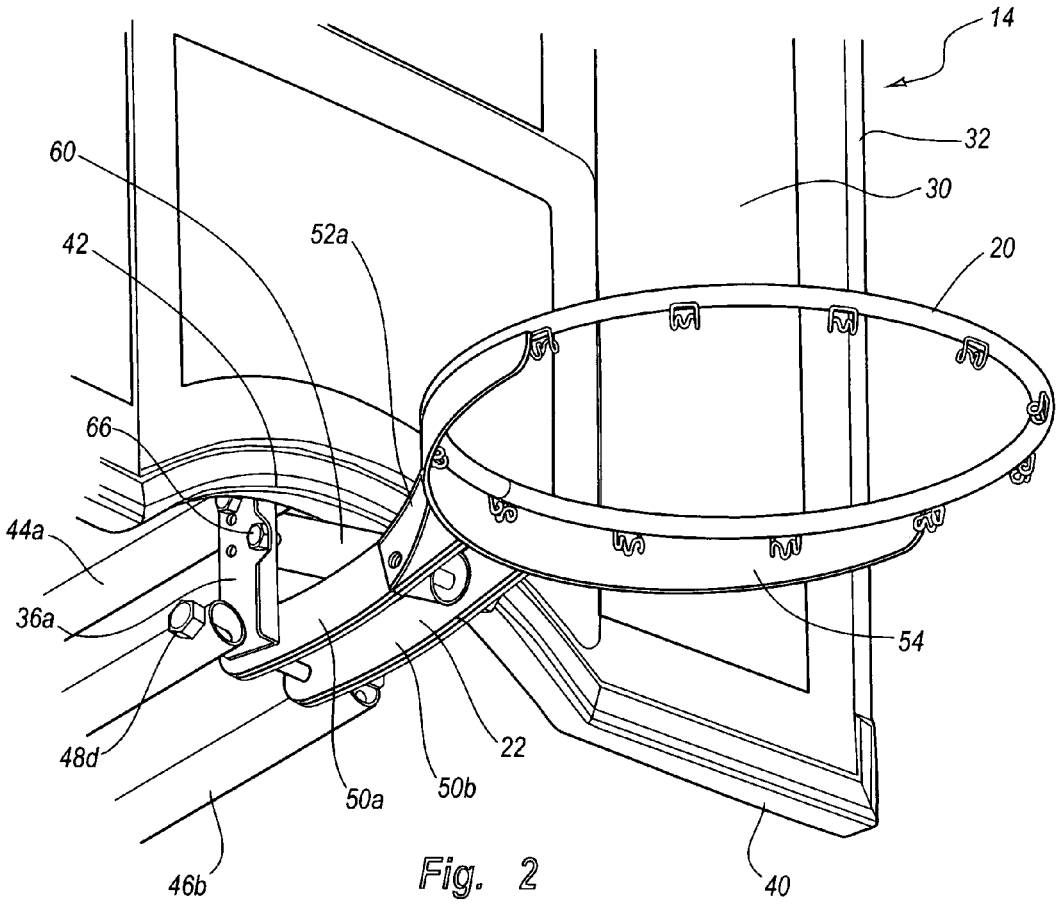
FIG. 2 is an enlarged bottom perspective view of an exemplary embodiment of a basketball rim assembly.

As best seen in FIGS. 1 and 2, the backboard 14 may include a rebound member 30 and a frame 32. The frame 32 is preferably sized and configured to support the rebound member 30 and prevent the rebound member from undesirably deflecting or breaking. The frame 32 may be constructed from materials with suitable characteristics such as metal or plastic. If the frame 32 is constructed from metal, for example, then the metal components may be stamped, formed or otherwise shaped into the desired configuration. In addition, the frame 32 could be constructed from a single metal component or multiple pieces that are interconnected to form the frame. On the other hand, if the frame 32 is constructed from plastic, for example, then the plastic frame may be formed from any suitable process such as injection molding, blow molding, compression molding and the like. One of ordinary skill in the art will appreciate that the backboard 14 could have any desired size and shape depending, for example, upon the intended use of the basketball goal system 10.

The rebound member 30 may be connected to the frame 32 by any suitable process such as fasteners, adhesives and the like. For example, suitable processes that may be used to connect the rebound member 30 to the frame 32 are disclosed in Assignee's co-pending U.S. patent application Ser. No. 09/228,325, which was filed on Jan. 11, 1999, entitled System and Method for Bonding an Acrylic Surface to a Frame, which is incorporated by reference in its entirety. One of ordinary skill in the art will appreciate that the rebound member 30 and the frame 32 may be connected in other desirable manners.

The rebound member 30 preferably has a generally smooth, planar outer surface 34 so that a basketball bounces or rebounds off the backboard 14 in a consistent and predictable manner. The rebound member 30 is preferably constructed from plastic and, in particular, from an acrylic sheet that has sufficient thickness so that it will not break during a game of basketball. The rebound member 30 is preferably constructed from an acrylic sheet because it is lightweight, easy to manufacture, and allows the backboard 14 to be easily assembled. In addition, the rebound member 30 is preferably constructed from acrylic or other suitable clear, transparent or generally translucent materials so that light can pass through the backboard 14. This creates a backboard 14 that is similar in appearance and characteristics to that used in professional and major college games. One of ordinary skill in the art, however, will appreciate that the rebound member 30 can be constructed from any suitable materials and the rebound member can be constructed from opaque or other types of solid materials.

One of ordinary skill in the art will also appreciate that the backboard 14 does not have to be constructed with a rebound member 30 and a frame 32 and, in contrast, the backboard could be constructed from a single components or multiple components that are interconnected. In addition, one of ordinary skill in the art will also appreciate that any suitable type of backboard 14 could be used in conjunction with the basketball goal system and the backboard could be constructed from any materials with the desired characteristics, such as metal, wood, plastic and the like.

The backboard support frame 16 is preferably sized and configured to securely attach the backboard 14 to the support structure 18. In particular, the backboard support frame 16 is preferably constructed from relatively strong materials, such as metal or steel, to create a strong, lightweight and durable frame, but other materials with suitable characteristics can also be used. Advantageously the metal components can be stamped and formed into the desired shapes and configurations. The backboard support frame 16 may also be constructed from multiple components that are connected by suitable fasteners, such as bolts, screws, or adhesives, or as a single, unitary structure. The backboard support frame 16 is preferably lightweight, strong and rigid to allow it to withstand repeated impacts with a basketball or other similar objects. The backboard support frame 16 may also be integrally formed as part of the backboard 14 and one of ordinary skill in the art will appreciate that the basketball goal system 10 does not require the backboard support frame.

Figure 3:
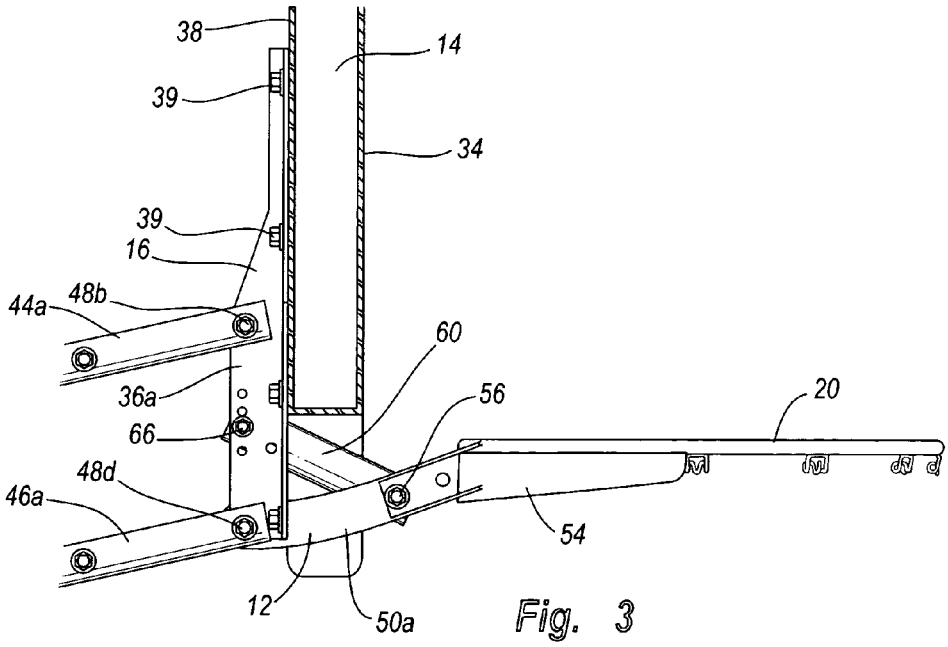
FIG. 3 is a side view of the basketball rim assembly shown in FIG. 2.

As shown in the accompanying figures, the backboard support frame 16 may include two elongated members 36*a*, 36*b* that are securely connected to the backboard 14. For example, as best seen in FIG. 3, the elongated members 36*a*, 36*b* may be attached to a rear surface 38 of the backboard 14 by one or more fasteners 39 such as bolts or screws. Of course, the support frame 16 may be connected to the backboard 14 by any suitable means such as adhesives and the like.

The elongated members 36*a*, 36*b* of the backboard support frame 16 preferably have a generally L-shaped configuration and are preferably positioned generally parallel to each other. The elongated members 36*a*, 36*b* are also preferably generally vertically aligned, but the elongated members could have other suitable shapes and configurations depending, for example, upon the size and shape of the backboard 14 and/or support structure 18.

The lower ends of the elongated members 36*a*, 36*b* preferably extend beyond a lower portion 40 of the backboard 14. In particular, the lower portion 40 of the backboard 14 may include a cutout or notch 42 and the lower ends of the elongated members 36 preferably extend at least beyond the cutout or notch 42. As shown in the accompanying figures, the lower ends of the elongated members 36*a*, 36*b* may also extend beyond a plane generally aligned with the lower portion 40 of the backboard 14. The backboard 14, however, does not require the cutout 42 and the elongated members 36 do not have to extend beyond the lower portion 40 of the backboard. Further, the backboard support frame 16 could have any suitable design and configuration depending, for example, upon the size and configuration of the backboard 14, support structure 18 and/or rim assembly 22.

The backboard support frame 16 is preferably connected to the support pole 12 of the basketball goal system 10 by the support structure 18. The support structure 18 preferably includes a pair of upper arms 44*a*, 44*b* and a pair of lower arms 46*a*, 46*b* that connect the backboard support frame 16 to the support pole 12. The upper arms 44*a*, 44*b* and lower arms 46*a*, 46*b* and the backboard support frame 16 preferably securely support the backboard 14 such that a basketball striking the backboard will deflect or move the backboard only a minimal amount. This creates a backboard 14 with good rebounding characteristics. In addition, the upper arms 44*a*, 44*b* and lower arms 46*a*, 46*b* are preferably generally parallel to each other to facilitate adjustment of the height of the basketball goal system 10, but one of ordinary skill in the art will recognize that the arms can have any suitable sizes and configurations depending, for example, upon the size and configuration of the backboard support frame 16 and/or the intended use of the basketball goal system. One of ordinary skill in the art will also recognize that the support structure 18 does not require pairs of upper and lower arms and, for example, only a single arm may be used to connect the backboard 14 to the support pole 12. Further, one of ordinary skill in the art will understand that the basketball goal system 10 does not have to be adjustable in height and, for example, the backboard 14 could be directly connected to the support pole 12.

In greater detail, as shown in the accompanying figures, the upper arms 44*a*, 44*b* are preferably connected to an upper portion of the support pole 12 by a fastener 48*a* and an upper portion of the elongated members 36 of the backboard support frame 16 by a fastener 48*b*. The lower arms 46*a*, 46*b* are preferably connected to the support pole 12 by a fastener 48*c* and a lower portion of the elongated members 36 of the backboard support frame 16 by a fastener 48*d*. The upper arms 44*a*, 44*b* and lower arms 46*a*, 46*b* of the support structure 18 are preferably pivotally connected to the support pole 12 and the backboard support frame 16 by the fasteners 48*a*, 48*b*, 48*c*, 48*d* to allow the height of the backboard 14 and rim 20 to be adjusted. It will be understood, however, that the height of the backboard 14 and rim 20 does not have to be adjustable and, for example, the support structure 18 could be directly connected to the backboard 14. In will also be understood that the support structure 18 could have other suitable arrangements and configurations depending, for example, upon the size backboard 14 and intended use of the basketball goal system 10. Further, while the fasteners 48*a*, 48*b*, 48*c*, 48*d* preferably comprise bolts, it will be understood that any suitable type of connector may be used.

As discussed above, the lower portions of the elongated members 36*a*, 36*b* of the backboard support frame 16 preferably extend below the lower portion 40 of the backboard 14 and are connected to the lower arms 46*a*, 46*b* of the support structure 18. Additionally, the lower portions of the elongated members 36*a*, 36*b* are preferably sized and configured to be connected to the rim assembly 22. In particular, the lower portions of the elongated members 36*a*, 36*b* are preferably pivotally attached to the rim assembly 22 to allow the rim assembly to pivot, but the rim assembly does not have to be pivotally attached to the elongated members. Desirably, the fastener 48*d* is used to connect the rim assembly 22 to the lower portions of the elongated members 36*a*, 36*b* and the lower arms 46*a*, 46*b* of the support structure 18, but the rim assembly could be connected to the elongated members of the backboard support frame 16 and/or the lower arms 46*a*, 46*b* of the support structure 18 by any suitable number or type of fasteners or connectors.

In greater detail, the rim assembly 22 preferably includes two support arms 50*a*, 50*b* and each support arm is connected to one of the elongated members 36*a*, 36*b* of the backboard support frame 16. The support arms 50*a*, 50*b* are preferably pivotally connected to the elongated members 36*a*, 36*b* of the backboard support frame 16 by the fastener 48*d*, but any suitable number or type of fasteners may be used. Because the elongated members 36*a*, 36*b* of the backboard support frame 16 are disposed behind the plane of the backboard 14, the connection of the rim assembly 22 to the backboard support frame is also disposed behind the plane of the backboard. It will be appreciated, however, that the connection of the rim assembly 22 to the backboard support frame 16 could also be below or in front of the backboard 14.

Figure 5:
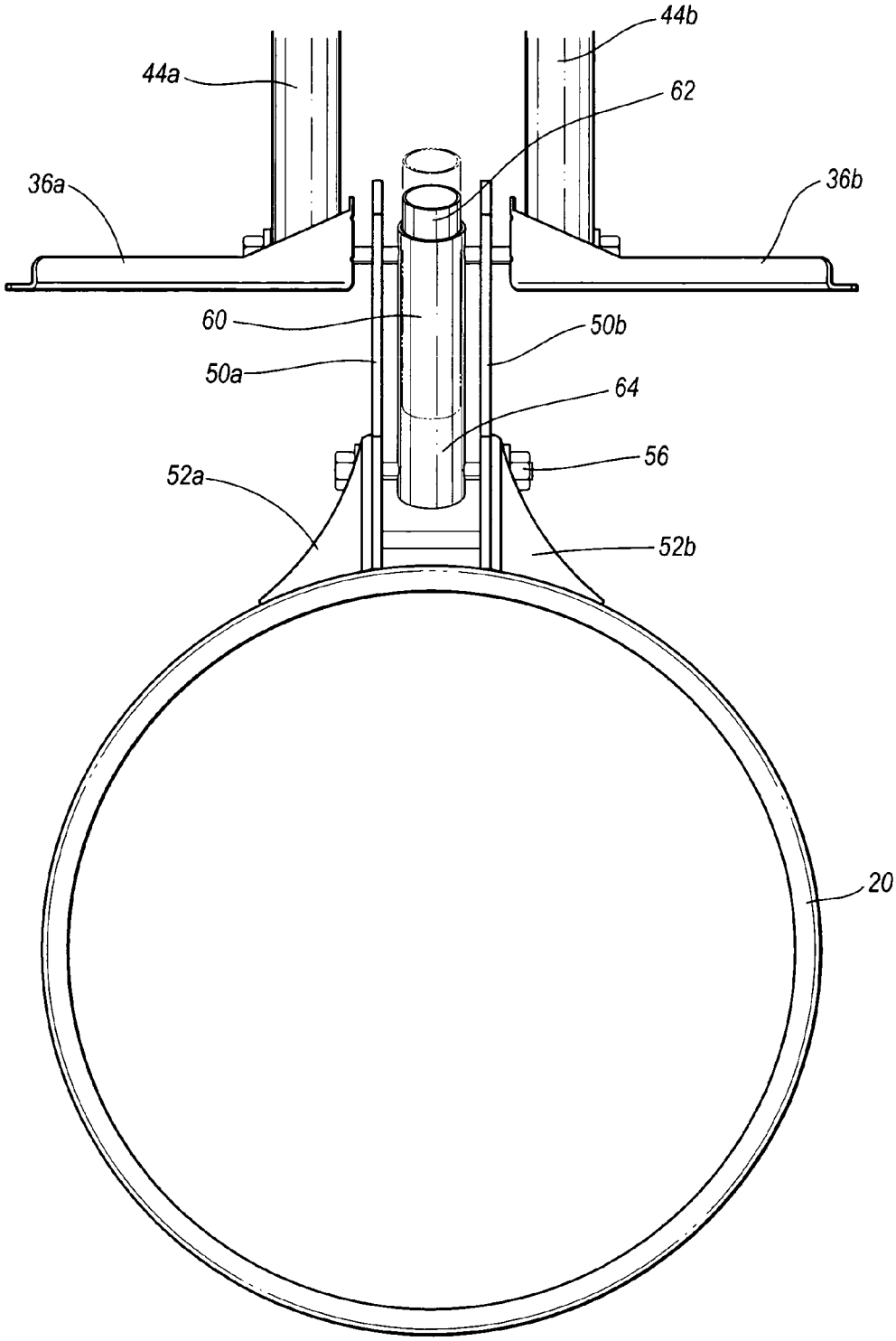
FIG. 5 is a top view of the basketball rim assembly shown in FIG. 2.

The rim 20 is attached to the other ends of the support arms 50*a*, 50*b* of the rim assembly 22. In particular, as best seen in FIGS. 2 and 5, the support arms 50*a*, 50*b* of the rim assembly 22 are preferably attached to different sides of the rim 20, but it will be appreciated that the rim could be attached to the rim assembly by any suitable manner. Additionally, one or more flanges 52*a*, 52*b* may be used to connect the support arms 50*a*, 50*b* to the rim 20. For example, the flanges 52*a*, 52*b* may be connected to the support arms 50*a*, 50*b*, respectively, and the rim 20 to provide a secure connection of the rim assembly 22 to the rim. Another flange 54 may be connected to a portion of the rim 20 and this flange may extend generally downwardly from a lower surface of the rim. The flanges 52*a*, 52*b* and/or support arms 50*a*, 50*b* may also be attached to the flange 54 to provide a secure connection of the rim assembly 22 to the rim 20. The support arms 50*a*, 50*b* and the flanges 52*a*, 52*b*, 54 are preferably securely connected to the rim 20 by welding but any suitable method or device may be used to connect the rim and rim assembly 22. In addition, one or more fasteners, such as fastener 56, may be used to connect the support arms 50*a*, 50*b* and/or the flanges 52*a*, 52*b*.

The rim assembly 22 is also connected to the backboard support frame 16 by an elongated connector 60. The elongated connector 60 includes a first end 62 that is connected to the backboard support frame 16 and a second end 64 that is connected to the rim assembly 22. Preferably, the first end 62 of the elongated connector 60 is connected to the elongated members 36*a*, 36*b* of the backboard support frame 16 by a fastener 66 such as a bolt and the second end 64 is preferably connected to the support arms 50*a*, 50*b* of the rim assembly 22 by the fastener 56. Desirably, the first and second ends 62, 64 of the elongated connector 60 are pivotally attached to the backboard support frame 16 and the rim assembly 22 by fasteners such as bolts, but the elongated connector could be attached to the backboard support frame and rim assembly in any suitable manner and by any suitable type of device or connection.

The elongated connector 60 is preferably a telescoping type connector that allows the length of the connector to be varied. For example, the elongated connector 60 may include a first member 70 that is at least partially disposed within a second member 72. The first and second members 70, 72 are preferably slidably disposed to allow the length of the connector 60 to change. One of ordinary skill in the art will appreciate that any suitable type of connector that allows its length to be adjusted may be used to connect the rim assembly 22 and the backboard support frame 16.

The elongated connector 60 that is adjustable in length is preferably used to create a breakaway type basketball rim. In particular, the elongated connector 60 is preferably sized and configured to allow the rim 20 and rim assembly 22 to pivot downwardly to create the breakaway type basketball rim. Accordingly, the elongated connector 60 is preferably pivotally connected to the elongated members 36*a*, 36*b* of the backboard support frame 16 and the support arms 50*a*, 50*b* of the rim assembly 22. Advantageously, the breakaway type rim helps absorb forces applied to the rim 20 and may help prevent damage to the rim and/or rim assembly 22. One of ordinary skill in the art will appreciate that the rim assembly 22 does not have to be used in connection with a breakaway type rim and, if so, the elongated connector 60 does not have to be adjustable in length or pivotally connected to either the elongated members 36*a*, 36*b* of the backboard support frame 16 or the support arms 50*a*, 50*b* of the rim assembly 22.

Figure 4A:
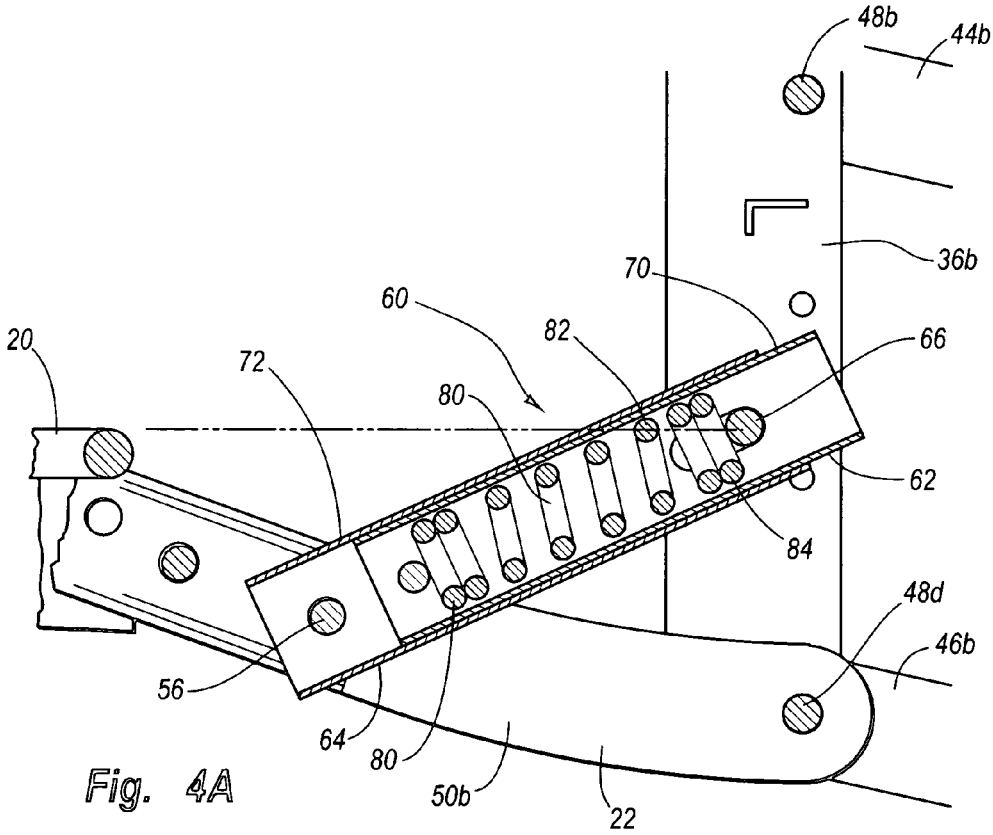
FIG. 4A is a partial cross-sectional side view of a portion of the basketball rim assembly shown in FIG. 2, illustrating the rim generally perpendicular to the backboard.
Figure 4B:
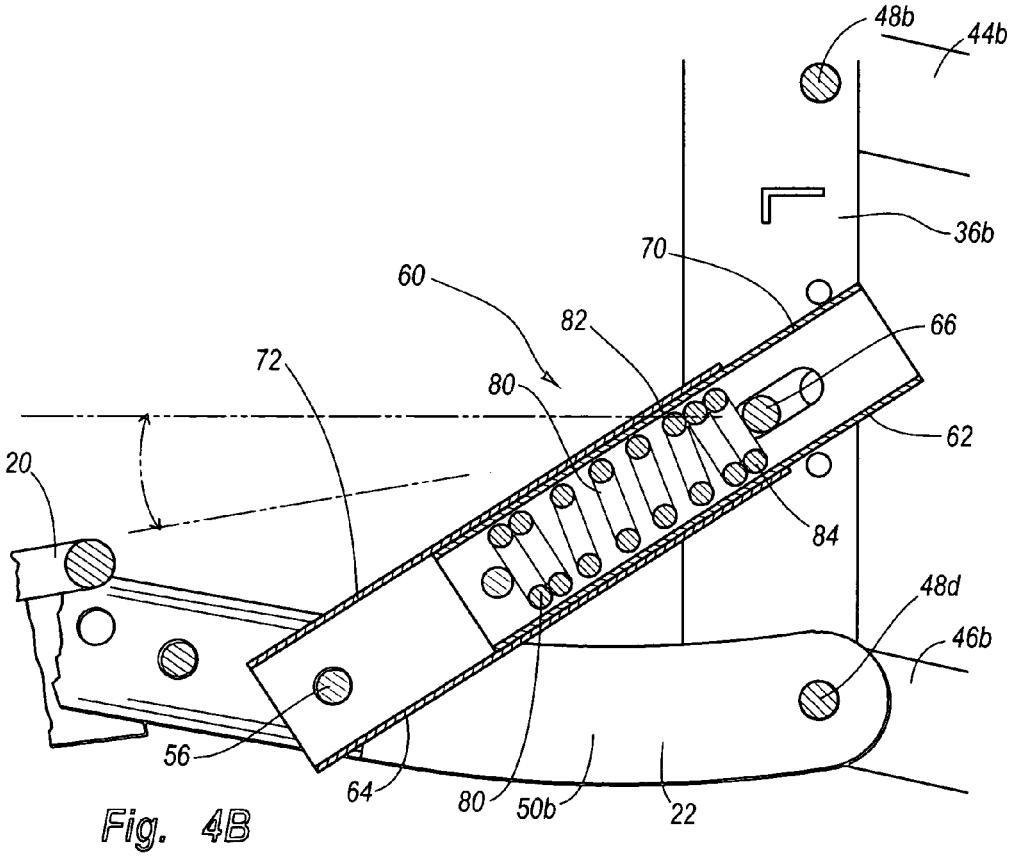
FIG. 4B is a partial cross-sectional side view of a portion of the basketball rim assembly shown in FIG. 2, illustrating the rim in a downwardly deflected angle relative to the backboard.

As seen in FIG. 4A, the rim 20 and rim assembly 22 are typically in a normal or first position in which the rim is generally perpendicular to the backboard 14. The rim 20 is normally in this position when basketball is being played. If a sufficiently large force is applied to the rim 20, however, the rim and rim assembly 22 will pivot into a deflected or second position in which the rim is pivoted downwardly towards the playing surface 26 as shown in FIG. 4B. Thus, the rim 20 is movable between a first or normal position and a second or deflected position.

A resistance mechanism 80 is preferably disposed within the elongated connector 60 and it may be used to control the movement and/or deflection of the rim 20 and rim assembly 22. The resistance mechanism 80 may include a spring 82, such as coil spring, but any suitable number and type of springs may be utilized. The spring 82 preferably biases the rim 20 and rim assembly 22 to remain in the first, normal position when playing basketball. The spring 82 may also have a spring rate that allows movement of the rim 20 and rim assembly 22 from the first, normal position to the second, deflected position when a force larger than a predetermined amount of force is applied to the rim. The spring 82 then returns the rim 20 and the rim assembly 22 to its first, normal position when the force applied to the rim is decreased below the predetermined amount or removed. Preferably, the spring 82 quickly returns the rim 20 and rim assembly 22 to the first, normal position so that there is no delay while playing basketball.

In greater detail, as best seen in FIG. 4A, a first end 84 of the spring 82 is disposed towards the first end 62 of the connector 60 and a second end 86 of the spring is disposed towards the second end 64 of the connector. When the rim 20 and rim assembly 22 are moved from the first, normal position to the second, deflected position, as shown in FIG. 4B, the spring 82 is compressed. When the force is removed from the rim 20, the spring 82 resiliently returns the rim and rim assembly 22 to its first, normal position. Thus, a compression type spring may be used as the resistance member 80, but one of ordinary skill in the art will understand that any suitable number, type and configuration of springs may be used. Additionally, one of ordinary skill in the art will understand that the resistance mechanism 80, such as the spring 82, may be in tension or compression depending, for example, upon the configuration of the resistance mechanism and location of the rim 20 and/or rim assembly 22. One of ordinary skill in the art will also understand that the resistance mechanism 80 may consist of any suitable type of expandable, flexible, stretchable, elastic, etc. type of device or structure that allows movement of the rim 20 and rim assembly 22.

Advantageously, the resistance mechanism 80 may be sized and configured to maintain the rim 20 and rim assembly 22 in the first, normal position in which the rim is generally parallel to the playing surface 26. In addition, the resistance mechanism 80 may also be sized and configured to hold the rim 20 and rim assembly in a rigid, secure position such that no unintended deflection or movement of the rim occurs during a basketball game. When a force or load greater than a predetermined amount is applied to the rim 20, the resistance mechanism 80 preferably allows a momentary downward deflection of the rim towards the playing surface 26 to help absorb the force or load on the rim. Desirably, this downward movement of the rim 20 helps prevent injury to the players and damage to the rim 20, rim assembly 22 and/or backboard 14. The resistance mechanism 80 preferably immediately returns the rim 20 to its first, normal position when the force is decreased below a given amount or removed.

The resistance of the resistance member 80 may be adjustable to allow the rim 20 and rim assembly 22 to deflect when different loads or forces are applied to the rim. This may allow the basketball goal system 10 to be used by players of various sizes and abilities. For example, the resistance member 80 could include a structure that allows the spring 82 to more freely expand or compress to allow the resistance provided by the spring to increase or decrease. One of ordinary skill in the art will appreciate that various other methods and devices may be used to adjust the amount of force that is required to move the rim 20 and rim assembly 22 between the normal and deflected positions depending, for example, upon the type of resistance mechanism being used.

As shown in the accompanying figures, the elongated connector 60 is preferably positioned between the backboard support frame 16 and the rim assembly 22 so that it does not interfere with playing the game of basketball. In particular, the first end 62 of the elongated connector 60 is preferably disposed between the elongated members 36*a*, 36*b* of the backboard support frame 16 and the second end 64 of the elongated connector is preferably disposed between the support arms 50*a*, 50*b* of the rim assembly 22. Locating the elongated connector 60 between the backboard support frame 16 and the rim assembly 22 may also allow the basketball goal system 10 with a pleasing aesthetic appearance and a relatively uncomplicated design. The location of the elongated connector 60 may also make the basketball goal system 10 easy to install and simple to maintain. It will be appreciated, however, that the elongated connector 60 could be attached to any suitable portions of the basketball goal system 10, such as the backboard 14, support structure 18 or the rim 20.

Advantageously, because the rim assembly 22 is preferably attached to the elongated members 36*a*, 36*b* of the backboard support frame 16 and not the backboard 14, forces caused by players contacting the rim 20 are not directly transmitted to the backboard, which helps prevents damage of the backboard. Additionally, because the rim assembly 22 is not connected to the backboard 14, no openings or slots must be formed in the backboard to allow attachment of the rim assembly or rim to the backboard. This may prevent, for example, the structural integrity of the backboard 14 from being decreased by the holes or slots, and it may prevent stress concentrations from being formed in the backboard.

Significantly, the rim assembly 22 can be used in connection with a wide range of suitable basketball goals and systems. For example, as discussed above, the rim assembly 22 may be used with a breakaway type rim, but the rim assembly may also be used in connection with a fixed, stationary type rim. In addition, the rim assembly 22 may be used with a basketball goal system that is adjustable in height. For example, the support pole 12 may include a telescoping portion that allows the length of the pole to be adjusted, which allows the height of the backboard and rim to be adjusted with respect to the playing surface. Various types of adjustable height basketball systems utilizing a telescoping pole that may be used with the basketball goal system 10 are disclosed in Assignee's U.S. Pat. Nos. 5,375,835 and 5,573,237, which are incorporated by reference in their entireties. One skilled in the art will appreciate that other suitable methods may be used to adjust the length of the support pole.

As seen in FIG. 1, the basketball goal system 10 may be used in connection with the height adjustment mechanism 24. Advantageously, the height adjustment mechanism 24 desirably allows the height of the backboard 14 and rim 20 to be adjusted without having to change the length of the support pole 12. Various suitable embodiments of the height adjustment mechanism 24 of disclosed in Assignee's U.S. Pat. Nos. 4,781,375; 4,805,904; 5,324,027; 4,881,734; 5,695,417; 5,879,247; 6,077,177; 6,120,396; 6,273,834; 6,422,957; 6,142,891; 6,419,598; 6,155,938; 6,419,597; or 6,402,644; each of which are incorporated by reference in their entireties.

Additionally, as also seen in FIG. 1, the basketball goal system 10 can be used in connection with a portable basketball system. For example, the support pole 12 can be connected to the 28 base and the base can be filled with ballast such as sand or water. The portable basketball system advantageously allows the basketball goal system 10 to be located in a plurality of desirable positions. Various embodiments of portable basketball systems that may be used in conjunction with the basketball goal system 10 are disclosed in Assignee's U.S. Pat. Nos. 5,836,838; 5,947,847; 6,027,418; and 6,432,003; and Assignee's copending U.S. patent application Ser. Nos. 10/212,443 and 10/050,612; each of which are incorporated by reference in their entireties.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball goal system comprising:

a support pole;

a backboard;

a support frame connected to the backboard, the support frame including two elongated members that extend below a lower portion of the backboard;

a support structure including a pair of upper arms and a pair of lower arms, the pair of upper arms being connected to the support pole and an upper portion of the elongated members of the support frame, the pair of lower arms being connected to the support pole and a lower portion of the elongated members of the support frame;

a rim assembly including a pair of support arms that are connected to the lower portion of the elongated members of the support frame and the lower pair of arms of the support structure;

a rim attached to the rim assembly; and a resistance mechanism, for maintaining said rim in a perpendicular plane to said backboard rim assembly, and said basketball goal assembly having a single fastener that pivotally connects the support arms of the rim assembly, the elongated members of the backboard support frame, and the lower pair of arms of the support structure.

2. The basketball goal system as in claim 1, wherein the attachment of the support arms of the rim assembly to the elongated members of the backboard support frame and the lower pair of arms of the support structure is behind a plane that is generally aligned with a front surface of the backboard.

3. The basketball goal system as in claim 1, further comprising a cutout in a lower surface of the backboard, the lower portions of the elongated members of the backboard support frame extending beyond the cutout in the lower surface of the backboard.

4. The basketball goal system as in claim 1, wherein a first end of the resistance mechanism is disposed between the elongated members of the support frame and a second end of the resistance mechanism is disposed between the support arms of the rim assembly.

5. The basketball goal system as in claim 1, wherein the resistance mechanism is biased to maintain the rim in a first position in which the rim is generally perpendicular to the backboard.

6. The basketball goal system as in claim 1, further comprising a first fastener that pivotally connects a first end of the resistance mechanism to the elongated members of the backboard support frame and a second fastener that pivotally connects a second end of the resistance mechanism to the support arms of the rim assembly.

7. A basketball goal system comprising:

a support pole;

a backboard;

a backboard support frame connected to the backboard;

a support structure connecting the backboard support frame to the support pole;

a rim;

a rim assembly including a first end and a second end, the first end of the rim assembly being connected to the backboard support frame, the second end of the rim assembly being connect to the rim; and an elongated connector including a first end that is connected to the backboard support frame and a second end that is connected to the rim assembly proximate the rim, the elongated connector including a resistance mechanism, for maintaining said rim in a perpendicular plane to said backboard.

8. The basketball goal system as in claim 7, wherein a lower portion of the backboard support frame extends below a lower portion of the backboard, the rim assembly and the elongated connector being connect to the lower portion of the backboard support frame that extends below the lower portion of the backboard.

9. The basketball goal system as in claim 7, wherein the rim assembly, backboard support frame and support structure are connected by a single fastener.

10. The basketball goal system as in claim 7, wherein the resistance mechanism is biased to maintain the rim in a first position in which the rim is generally perpendicular to the backboard.

11. The basketball goal system as in claim 7, further comprising a first fastener that pivotally connects a first end of the resistance mechanism to the backboard support frame and a second fastener that pivotally connects a second end of the resistance mechanism to the rim assembly.

12. A basketball goal system comprising:

a support structure including a pair of upper support arms and a pair of lower support arms;

a backboard support frame including a pair of elongated members, each of the elongated members being connected to one of the upper support arms and one of the lower support arms of the support structure;

a backboard connected to the backboard support frame;

a rim assembly including a pair of support arms, each of the support arms being connected to one of the elongated members of the backboard support frame;

a rim attached to the rim assembly; and a resistance mechanism for maintaining said rim in a perpendicular plane to said backboard.

13. The basketball goal system as in claim 12, wherein the resistance mechanism is connected to the rim assembly proximate the rim.

14. The basketball goal system as in claim 12, wherein the support arms of the rim assembly are connected to the pair of lower pair of the support structure.

15. The basketball goal system as in claim 12, wherein a first end of the resistance mechanism is disposed between the pair of elongated members of the backboard support frame and a second end of the resistance mechanism is disposed between the pair of support arms of the rim assembly.

16. The basketball goal system as in claim 12, further comprising a single fastener that pivotally connects the support arms of the rim assembly, the elongated members of the backboard support frame, and the lower pair of arms of the support structure.

17. The basketball goal system as in claim 12, wherein the support arms of the rim assembly are connected to the elongated members of the backboard support frame and the lower pair of arms of the support structure behind a plane that is generally aligned with a front surface of the backboard.

18. The basketball goal system as in claim 12, further comprising a cutout in a lower surface of the backboard and the elongated members of the backboard support frame extending beyond the cutout in the lower surface of the backboard.

19. The basketball goal system as in claim 12, wherein a lower portion of the elongated members of the backboard support frame extends below a lower portion of the backboard, the rim assembly and the resistance mechanism being connect to the lower portion of the elongated members of the backboard support frame that extends below the lower portion of the backboard.

20. The basketball goal system as in claim 12, further comprising a first fastener that pivotally connects a first end of the resistance mechanism to the elongated members of the backboard support frame and a second fastener connects a second end of the resistance mechanism to the support arms of the rim assembly.

21. A basketball backboard assembly comprising:

a backboard including a front portion, a rear portion and a lower portion;

a support frame connected to the rear portion of the backboard, at least a portion of the support frame extending below the lower portion of the backboard;

a rim movable between a first position in which the rim is disposed generally perpendicular to the front portion of the backboard and a second position in which the rim is disposed at a different angle relative to the front portion of the backboard;

a rim attachment portion that is connected to the rim and a portion of the support frame extending below the lower portion of the backboard; and a resistance mechanism, for maintaining said rim in a perpendicular plane to said backboard portion and wherein the support frame includes two elongated members; wherein the rim attachment portion includes two support arms; and wherein a first end of the resistance mechanism is disposed between the elongated members of the support frame and a second end of the resistance mechanism is disposed between the support arms of the rim assembly.

22. The basketball backboard assembly as in claim 21, wherein the resistance mechanism is sized and configured to bias the rim into the first position.

23. The basketball backboard assembly as in claim 21, wherein the resistance mechanism is connected to the rim assembly proximate the rim.

24. The basketball backboard assembly as in claim 21, wherein at least a portion of the resistance mechanism is disposed in front of the front portion of the backboard.

25. The basketball backboard assembly as in claim 21, wherein at least a portion of the resistance mechanism is disposed behind the rear portion of the backboard.

26. The basketball backboard assembly as in claim 21, wherein at least a portion of the resistance mechanism is disposed in front of the front portion of the backboard and at least a portion of the resistance mechanism is disposed behind the rear portion of the backboard.

* * * * *

UNITED STATES PATENT AND TRADEMARK OFFICE

CERTIFICATE OF CORRECTION

PATENT NO. : 7,048,655 B2 
APPLICATION NO. : 10/802433
DATED : May 23, 2006
INVENTOR(S) : Nye et al.

It is certified that error appears in the above-identified patent and that said Letters Patent is hereby corrected as shown below:

Delete Title page illustrating figure, and substitute therefor, new Title page illustrating figure. (attached)

Drawings

Sheet 1, replace Figure 1 with the figure depicted herein below in which, the "height adjustment system" has been labeled with-- 24--

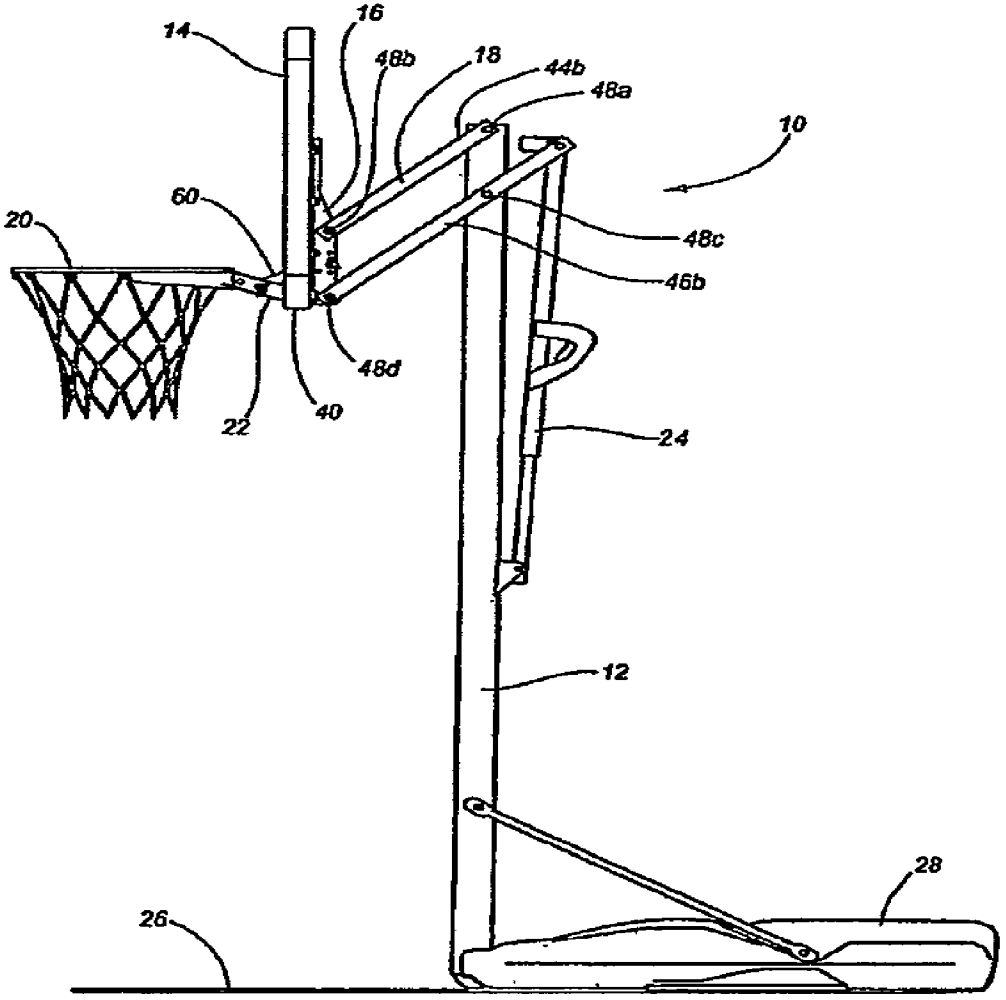

Fig. 1

UNITED STATES PATENT AND TRADEMARK OFFICE

CERTIFICATE OF CORRECTION

PATENT NO. : 7,048,655 B2 
APPLICATION NO. : 10/802433
DATED : May 23, 2006
INVENTOR(S) : Nye et al.

It is certified that error appears in the above-identified patent and that said Letters Patent is hereby corrected as shown below:

Drawings

Sheet 3, replace Figure 4A with the figure depicted herein below, in which the "second end" of "spring 82" labeled "80" has been relabeled with --86--

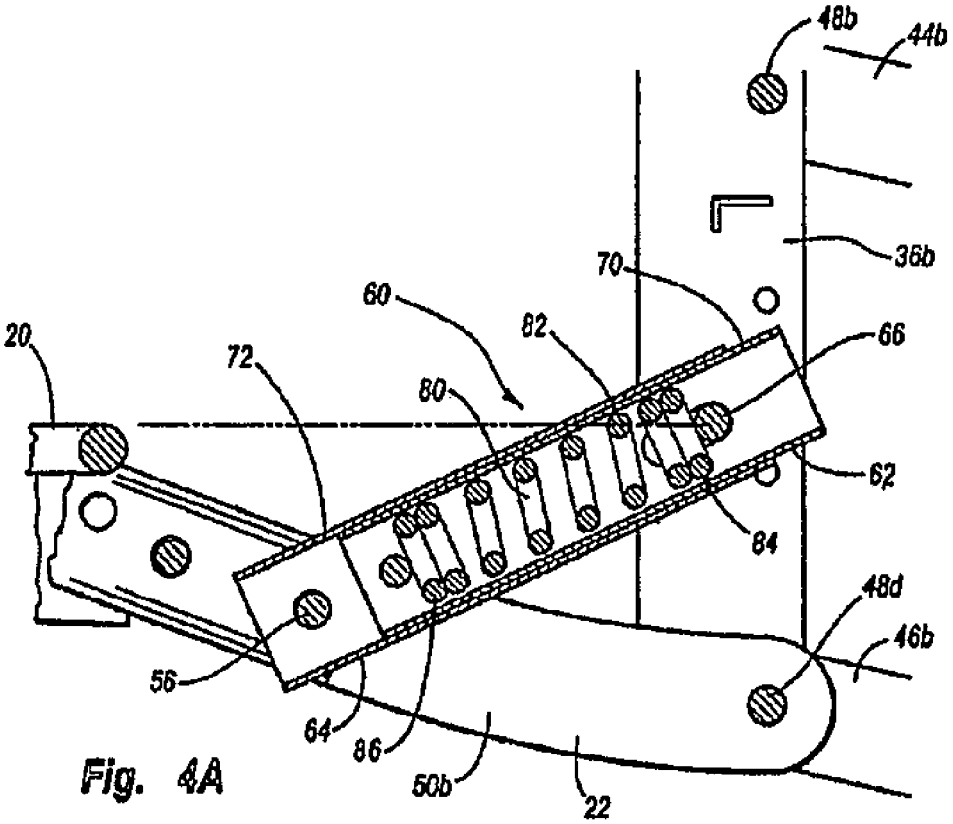

Fig. 4A

UNITED STATES PATENT AND TRADEMARK OFFICE

CERTIFICATE OF CORRECTION

PATENT NO. : 7,048,655 B2 
APPLICATION NO. : 10/802433
DATED : May 23, 2006
INVENTOR(S) : Nye et al.

It is certified that error appears in the above-identified patent and that said Letters Patent is hereby corrected as shown below:

Drawings

Sheet 3, replace Figure 4B with the figure depicted herein below, in which the "second end" of "spring 82" labeled "80" has been relabeled with --86--

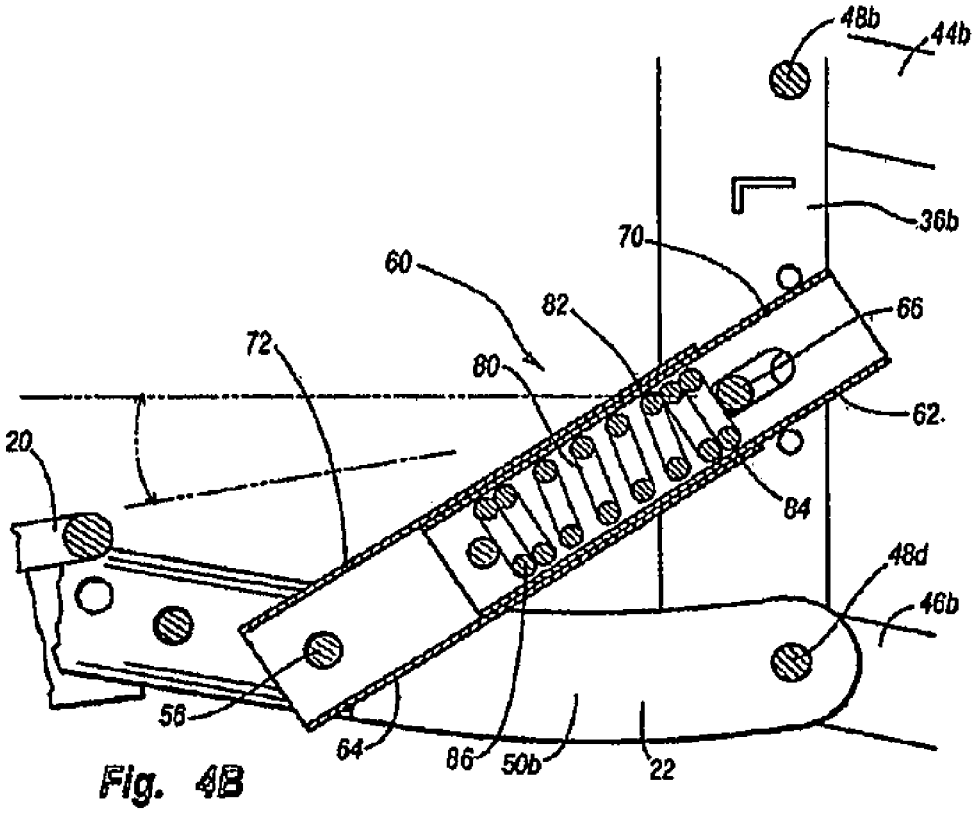

Fig. 4B

Column 2

Line 32, change "basketballs" to --backboards--

Line 45, change "backboard" to --backboards--

Column 3

Line 11, change "being" to --begin--

Line 12, change "to" to --will--

UNITED STATES PATENT AND TRADEMARK OFFICE

CERTIFICATE OF CORRECTION

PATENT NO. : 7,048,655 B2
APPLICATION NO. : 10/802433
DATED : May 23, 2006
INVENTOR(S) : Nye et al.

It is certified that error appears in the above-identified patent and that said Letters Patent is hereby corrected as shown below:

Column 6
Line 23, change “limits” to --limit--

Column 12
Line 34, change “with” to --to have--

Column 13
Line 29, change “application” to --applications--

Column 15
Line 8, change “pair” to --support--

Signed and Sealed this

Twenty-seventh Day of February, 2007

JON W. DUDAS
*Director of the United States Patent and Trademark Office*

(12) United States Patent
Nye et al.

(10) Patent No.: US 7,048,655 B2
(45) **Date of Patent: *May 23, 2006**

(54) BASKETBALL RIM ASSEMBLY

(75) Inventors: S. Curtis Nye, Clinton, UT (US); Carl R. Stanford, Clinton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 39 days.

This patent is subject to a terminal disclaimer.

(21) Appl. No.: 10/802,433

(22) Filed: Mar. 17, 2004

(65) Prior Publication Data

US 2005/0003910 A1 Jan. 6, 2005

Related U.S. Application Data

(60) Provisional application No. 60/455,647, filed on Mar. 18, 2003.

(51) Int. Cl.
*A63B 63/08* (2006.01)

(52) U.S. Cl. ..... 473/486; 473/481; 473/483; 473/484; 248/283.1; 248/280.11; D21/701

(58) Field of Classification Search ..... 473/479, 473/480, 481, 486, 483; D21/701; 248/283.1, 248/280.11

See application file for complete search history.

(56) References Cited

U.S. PATENT DOCUMENTS 2,932,511 A * 4/1960 Beams ..... 473/481
3,365,196 A * 1/1968 Miller ..... 473/485
3,970,304 A * 7/1976 Ebstein et al. ..... 473/481
4,465,277 A * 8/1984 Dittrich ..... 473/447
D498,800 S * 11/2004 Nye et al. ..... D21/701

* cited by examiner

*Primary Examiner*—Eugene Kim
*Assistant Examiner*—M. Chambers
(74) *Attorney, Agent, or Firm*—Workman Nydegger

(57) ABSTRACT

A basketball goal system may include a rim assembly that forms part of a breakaway rim that can deflect downwardly when a force larger than a predetermined amount is applied to the rim. The basketball goal system may include a support pole, a support structure including a pair of upper arms and a pair of lower arms, a backboard support frame including a pair of elongated members, and a backboard. The elongated members of the backboard support frame are preferably connected to one of the upper support arms and one of the lower support arms of the support structure, and these upper and lower support arms are preferably connected to the support pole. The basketball goal system may also include a backboard connected to the backboard support frame and a rim assembly including a pair of support arms. The support arms of the rim assembly are preferably connected to the elongated members of the backboard support frame. The basketball goal system may also include a rim attached to the rim assembly and a resistance mechanism that is preferably connected to the pair of elongated members of the backboard support frame and the pair of support arms of the rim assembly.

26 Claims, 4 Drawing Sheets

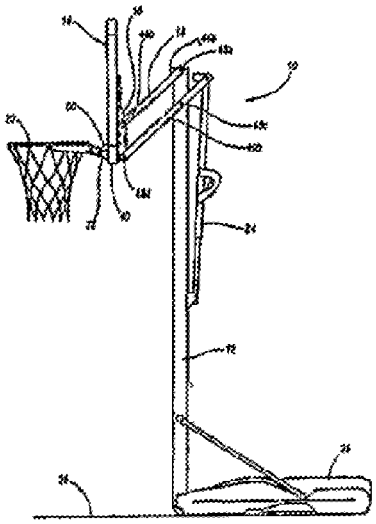

UNITED STATES PATENT AND TRADEMARK OFFICE

CERTIFICATE OF CORRECTION

PATENT NO. : 7,048,655 B2
APPLICATION NO. : 10/802433
DATED : May 23, 2006
INVENTOR(S) : Nye et al.

It is certified that error appears in the above-identified patent and that said Letters Patent is hereby corrected as shown below:

Column 14 Claim 7
Line 31, change “connect” to --connected--
Line 41, change “connect” to --connected--

Column 15 Claim 14
Line 8, after “lower pair” insert --of arms--
Claim 19, Line 35, change “connect” to --connected--

Signed and Sealed this

Tenth Day of April, 2007

JON W. DUDAS
*Director of the United States Patent and Trademark Office*